US011829090B2

(12) United States Patent
Maruyama et al.

(10) Patent No.: US 11,829,090 B2
(45) Date of Patent: Nov. 28, 2023

(54) FIXING DEVICE

(71) Applicant: BROTHER KOGYO KABUSHIKI KAISHA, Nagoya (JP)

(72) Inventors: Yasuhiro Maruyama, Nagoya (JP); Makoto Souda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/807,036

(22) Filed: Jun. 15, 2022

(65) Prior Publication Data

US 2022/0404746 A1 Dec. 22, 2022

(30) Foreign Application Priority Data

Jun. 16, 2021 (JP) ..... 2021-100088

(51) Int. Cl.
*G03G 15/20* (2006.01)

(52) U.S. Cl.
CPC ..... *G03G 15/2039* (2013.01); *G03G 15/2028* (2013.01)

(58) Field of Classification Search
CPC ..... G03G 15/2039; G03G 15/2028
See application file for complete search history.

(56) References Cited

U.S. PATENT DOCUMENTS 10,935,912 B1 * 3/2021 Yokoyama ..... G03G 15/2064
2015/0338795 A1 11/2015 Yamaguchi
2016/0132006 A1 5/2016 Narahara et al.
2016/0216659 A1 7/2016 Ikegami et al.
2019/0339638 A1 11/2019 Kinukawa et al.
2020/0033774 A1 1/2020 Shinji et al.
2020/0096917 A1 3/2020 Koyanagi et al.
2020/0174407 A1 * 6/2020 Furuichi ..... G03G 15/2039

FOREIGN PATENT DOCUMENTS

JP 2016-090865 A 5/2016
JP 2016139002 A 8/2016
JP 2018028704 A 2/2018
JP 2019194649 A 11/2019
JP 2020016825 A 1/2020
JP 2020046583 A 3/2020

* cited by examiner

*Primary Examiner* — Victor Verbitsky
(74) *Attorney, Agent, or Firm* — Scully, Scott, Murphy & Presser, PC

(57) ABSTRACT

A fixing device includes a heater, an endless belt, a holder, a temperature detector, and a partition sheet. The heater includes a substrate, and a resistance heating element provided on the substrate, and has a frontside surface and a backside surface opposite to the frontside surface. The endless belt is configured to rotate around the heater and has an inner peripheral surface in contact with the frontside surface of the heater. The holder holds the heater. The temperature detector is configured to detect a temperature of the heater and has a detection surface that detects a temperature. The partition sheet is located between the backside surface of the heater and the holder, and is in contact with the detection surface. A length of the partition sheet in a direction of conveyance of a recording material is longer than a length of the heater in the direction of conveyance.

15 Claims, 9 Drawing Sheets

FIXING DEVICE

REFERENCE TO RELATED APPLICATIONS

This application claims priority from Japanese Patent Application No. 2021-100088 filed on Jun. 16, 2021. The entire content of the priority application is incorporated herein by reference.

BACKGROUND ART

A heating unit for a fixing device known in the art comprises a heater including a substrate and a resistance heating element formed on the substrate, an endless belt that rotates around the heater, and a holder that supports the heater. In such a heating unit, the heater has a first surface in contact with an inner peripheral surface of the belt, and a second surface opposite to the first surface, and a heat insulation sheet is located between the second surface and the holder. More specifically, the heat insulation sheet is located between the second surface of the heater and a temperature detector such as a thermistor or a thermal fuse. The inner peripheral surface of the belt is coated with grease (lubricant) to thereby ensure sliding properties between each of the heater and the holder, and the inner peripheral surface of the belt.

DESCRIPTION

In a prior art configuration, a length of the heat insulation sheet in the direction of conveyance of a recording material is the same as a length of the heater in the direction of conveyance. Therefore, lubricant provided between the heater and the belt could possibly flow to a backside of the heat insulation sheet, that is, a side on which a temperature detector is located. If lubricant that has flowed to the backside adheres, for example, on a temperature detection surface of the temperature detector, the temperature detector will fail to function properly.

It would be desirable to provide a fixing device configured to restrain lubricant provided between the heater and the belt from flowing to the backside of a partition sheet.

In one aspect, a fixing device disclosed herein comprises a heater, an endless belt, a holder, a temperature detector, and a partition sheet. The heater comprises a substrate, and a resistance heating element provided on the substrate. The heater has a frontside surface and a backside surface opposite to the frontside surface. The endless belt is configured to rotate around the heater. The endless belt has an inner peripheral surface in contact with the frontside surface of the heater. Lubricant is provided between the endless belt and the frontside surface. The holder holds the heater. The temperature detector is configured to detect a temperature of the heater. The temperature detector has a detection surface that detects a temperature. The partition sheet is located between the backside surface of the heater and the holder. The partition sheet is in contact with the detection surface. A length of the partition sheet in a direction of conveyance of a recording material is longer than a length of the heater in the direction of conveyance.

According to the above configuration, lubricant provided between the heater and the belt can be restrained by the partition sheet from flowing to the backside of the partition sheet, i.e., to the temperature detector.

The above and other aspects, their advantages and further features will become more apparent by describing in detail illustrative, non-limiting embodiments thereof with reference to the accompanying drawings briefly described below.

Figure 1:
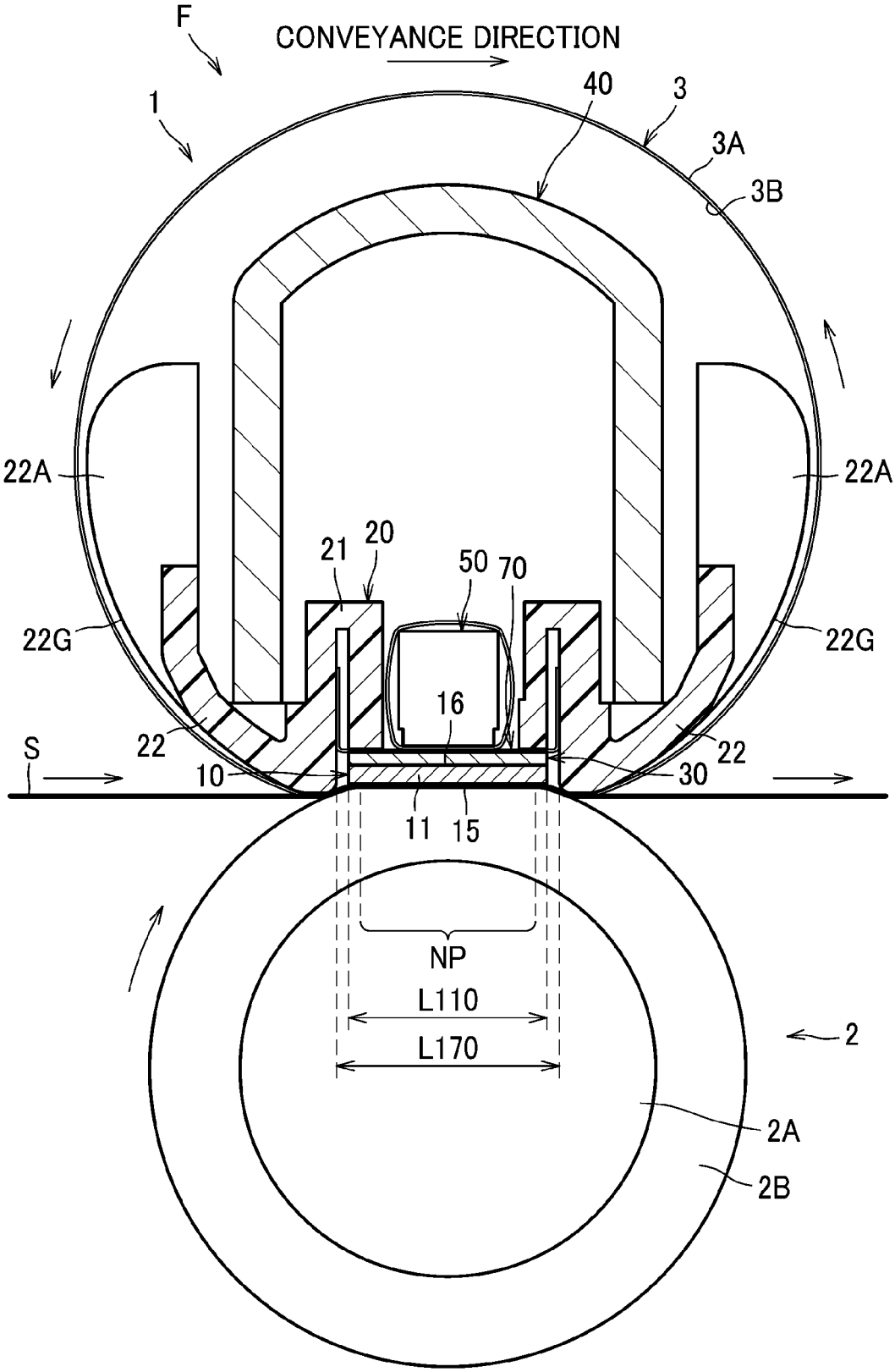
FIG. 1 is a section view of a fixing device.

The fixing device F shown in FIG. 1 is used in an electrographic image forming apparatus or a foil transfer device for thermally transferring a foil, and comprises a heating unit 1 and a pressure roller 2 as one example of a pressure unit. The fixing device F is configured to convey a recording material S such as a sheet of paper in a predetermined direction by the heating unit 1 and the pressure roller 2. In the following description, the direction of conveyance of a recording material S within the fixing device F will be referred to simply as "conveyance direction", and a direction perpendicular to the conveyance direction will be referred to simply as "lateral direction" (see FIG. 2).

The pressure roller 2 is a member for forming a nip NP in combination with a heater 10 which will be described below. To be more specific, a belt 3 which will be described below is held between the pressure roller 2 and the heater 10, and the nip NP is formed between the pressure roller 2 and the belt 3. The pressure roller 2 comprises a shaft 2A and a roller portion 2B formed around the shaft to cover a part of a periphery of the shaft 2A. The shaft 2A is made, for example, of metal, and the roller portion 2B is made, for example, of rubber or other material having a high heat resistance. In the fixing device F, one of the heating unit 1 and the pressure roller 2 is pressed against the other of the heating unit 1 and the pressure roller 2.

The heating unit 1 is a device for heating a recording material S, and comprises the belt 3, the heater 10, a holder 20, a thermally-conductive member 30, a stay 40, a temperature detector 50, and a partition sheet 70. It should be understood that "lateral direction" described above corresponds to longitudinal directions of the heater 10, holder 20, thermally-conductive member 30, and partition sheet 70, and "conveyance direction" corresponds to direction of widths, perpendicular to the longitudinal directions, of the heater 10, holder 20, thermally-conductive member 30, and partition sheet 70.

The belt 3 is an endless belt made of metal and/or plastic and the like. The belt 3 is guided by the holder 20 and rotates around the heater 10. The belt 3 has an outer peripheral surface 3A and an inner peripheral surface 3B. The outer peripheral surface 3A contacts a recording material S which is an object to be heated. The inner peripheral surface 3B is in contact with a frontside surface 15 of the heater 10, with lubricant being provided between the inner peripheral surface 3B and the frontside surface 15. The lubricant is grease having heat resistance. The pressure roller 2 is driven to rotate in a clockwise direction in FIG. 1, and thereby causes the belt 3 to rotate in a counterclockwise direction in FIG. 1.

Figures 2A, 2B:
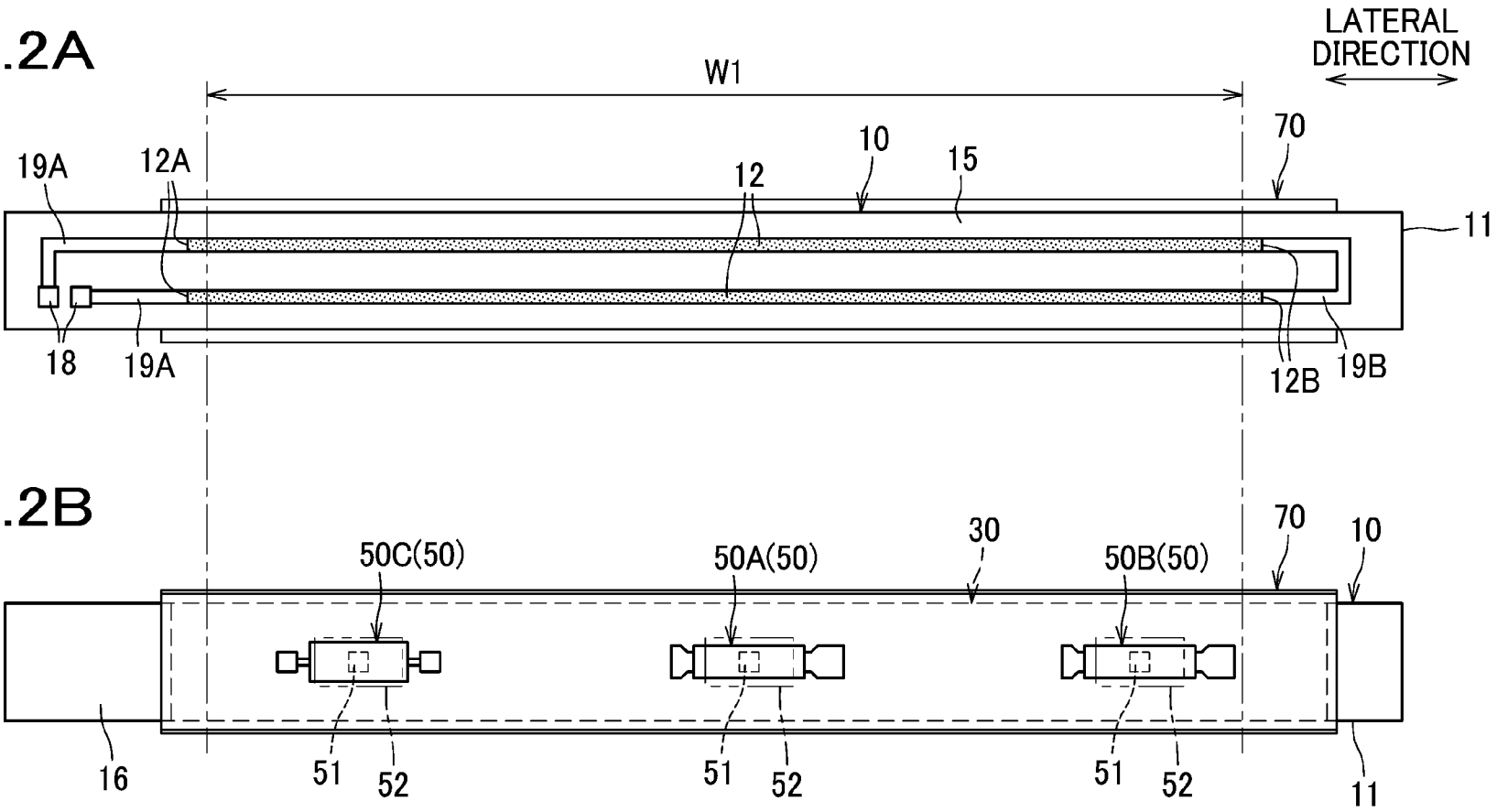
FIG. 2A is an illustration of a heater and a partition sheet as viewed from a front side thereof.
FIG. 2B is an illustration of a heater, a temperature detector, and a partition sheet as viewed from a back side surface thereof.

As shown in FIG. 2A, the heater 10 comprises a substrate 11 and a resistance heating element 12 provided on the substrate 11. The substrate 11 is comprised of an elongated rectangular plate made of ceramic. The heater 10 is a so-called ceramic heater.

The resistance heating element 12 is formed on one side of the substrate 11 by printing. In the illustrated example, two resistance heating elements 12 are provided. Each of the resistance heating elements 12 is long in the lateral direction. The resistance heating elements 12 are placed parallel to and spaced apart from each other in the conveyance direction perpendicular to the lateral direction.

Each resistance heating element 12 has one end 12A connected to one end of a corresponding conductor 19A. A terminal 18 for providing electricity is provided on the other end of the conductor 19A. Each resistance heating element 12 has another end 12B. The ends 12B are connected to one another by a conductor 19B. The one end 12A and the other end 12B of each resistance heating element 12 are located in a position outside an area W1 through which a recording material S with a maximum width conveyable in the fixing device F can pass.

The resistance heating element 12 and the surface of the substrate 11 on which the resistance heating element 12 is formed are covered by a cover (not shown) made of glass or the like.

It is to be understood that any number of resistance heating elements 12 may be provided. Further, it is possible to provide a resistance heating element with an amount of heat generation at a middle portion thereof larger than amounts of heat generation at end portions thereof in the lateral direction, and a resistance heating element with amounts of heat generation at end portions thereof larger than an amount of heat generation at a middle portion thereof in the lateral direction, so as to adjust heating distribution in the lateral direction by individually controlling each of the resistance heating elements.

Returning to FIG. 1, the heater 10 has the frontside surface 15 in contact with the inner peripheral surface 3B of the belt 3, and a backside surface 16 opposite to the frontside surface 15.

The holder 20 is a member that holds the heater 10, the thermally-conductive member 30 and other components. The holder 20 is made of plastic and the like, and comprises a support portion 21 and a guide portion 22.

The support portion 21 supports the heater 10, the thermally-conductive member 30 and the partition sheet 70, and has a shape corresponding to a shape of the heater 10 that is long in the lateral direction. The support portion 21 has an upstream end and a downstream end in the conveyance direction.

In the illustrated example, two guide portions 22 are provided one on the upstream end and one on the downstream end, of the support portion 21. Each guide portion 22 has a guide surface 22G that extends along the inner peripheral surface 3B of the belt 3. Each guide portion 22 includes a plurality of guide ribs 22A aligned in the lateral direction.

The stay 40 is a member that supports the holder 20. The stay 40 is made of a material having a rigidity larger than that of the holder 20, for example, metal. As one example, the stay 40 is formed by folding a steel sheet in a U-shape.

Figure 3:
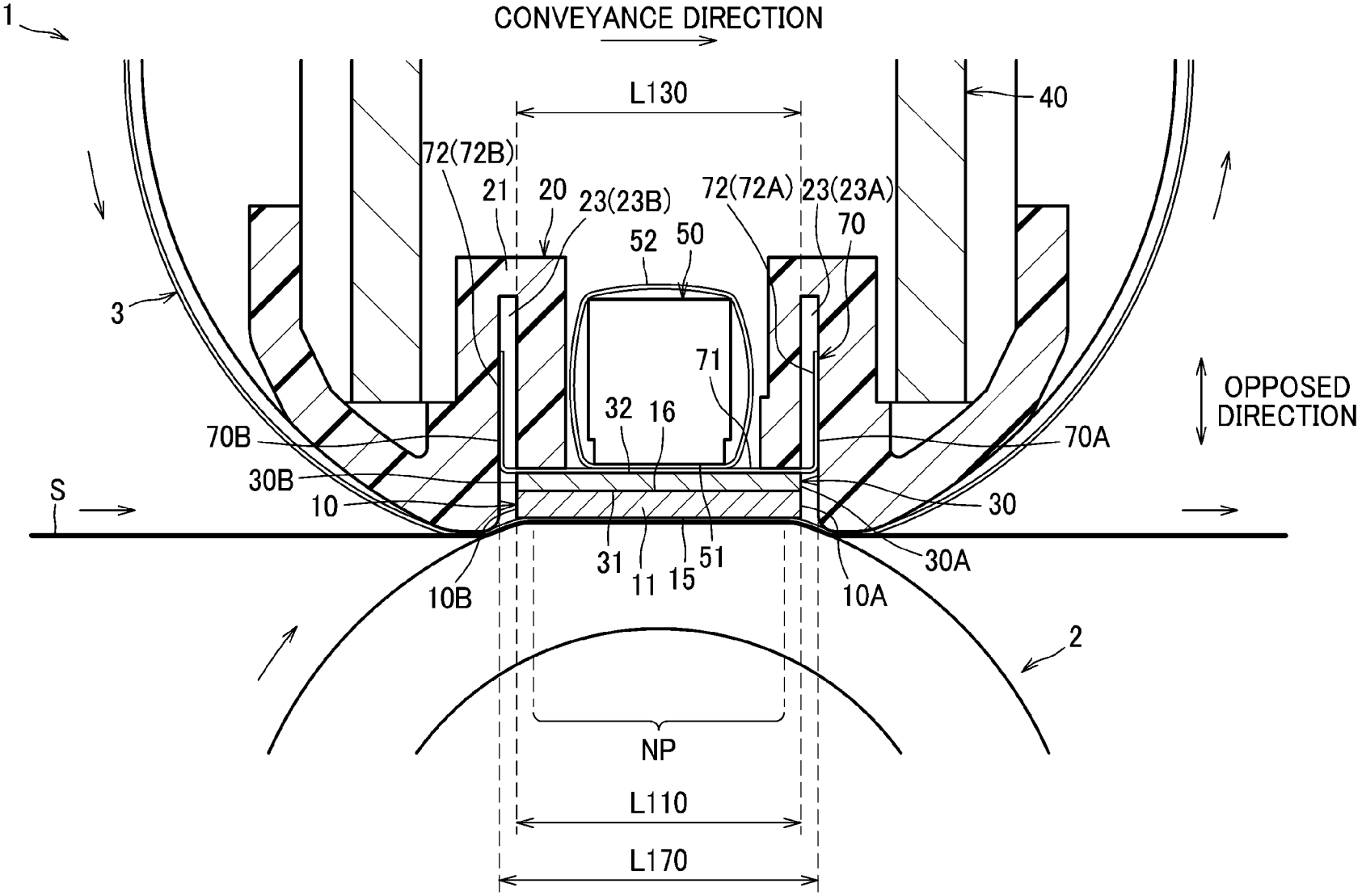
FIG. 3 is an enlarged section view, showing a partition sheet and its vicinity, of the fixing device.

As shown in FIG. 3, the thermally-conductive member 30 is a member for conducting heat in the lateral direction to equalize a temperature of the heater 10 in the lateral direction. The thermally-conductive member 30 is a sheet-shaped member located between the backside surface 16 of the heater 10 and the support portion 21 of the holder 20. When the heating unit 1 holds the recording material S which is the object to be heated, in combination with the pressure roller 2, the thermally-conductive member 30 is held between the heater 10 and the support portion 21. The thermally-conductive member 30 has a heater-side surface 31 in contact with the backside surface 16 of the heater 10 and an opposite surface 32 opposite to the heater-side surface 31.

The thermally-conductive member 30 has a thermal conductivity in a direction parallel to the heater-side surface 31 (referred to below simply as "flat-surface direction") higher than a thermal conductivity of the substrate 11 in the flat-surface direction. The thermally-conductive member 30 may be made of any kind of material. For example, a metal with a high thermal conductivity such as aluminum, aluminum alloys, and copper can be used. The thermally-conductive member 30 is preferably an anisotropic thermally-conductive member having a thermal conductivity in the flat-surface direction larger than that in a direction perpendicular to the heater-side surface 31. For example, a graphite sheet may be used as the anisotropic thermally-conductive member. The thermally-conductive member 30 may have any thickness and may be formed, for example, as a film thinner than 0.1 mm or as a plate thicker than 1 mm.

The partition sheet 70 is a member that reduces heat transferred to the temperature detector 50 in the early stages of heating by the heater 10. The partition sheet 70 is located between the backside surface 16 of the heater 10 and the support portion 21 of the holder 20. The partition sheet 70 has a contact surface in contact with the backside surface of the heater 10. When the heating unit 1 holds the recording material S in combination with the pressure roller 2, the partition sheet 70 is held together with the thermally-conductive member 30 between the heater 10 and the support portion 21.

The partition sheet 70 is positioned on a side of the thermally-conductive member 30 opposite to a side of the thermally-conductive member 30 on which the heater 10 is positioned. In other words, the thermally-conductive member 30 is located between the back side surface 16 of the heater 10 and the partition sheet 70. The partition sheet 70 is located between the opposite side 32 of the thermally-conductive member 30 and the support portion 21 of the holder 20. In the following description, a direction in which the backside surface 16 of the heater 10 and a surface of the partition sheet 70 are opposed to each other is referred to as "opposed direction". The opposed direction is a direction perpendicular to the conveyance direction and the lateral direction.

The partition sheet 70 is a member having a thermal conductivity in the flat-surface direction lower than that of the substrate 11. The partition sheet 70 may be made of any kind of material. For example, a high-heat-resistant plastic or other material having a thermal conductivity lower than that of ceramic may be used. Further, the partition sheet 70 may have any thickness, and may be, for example, either thinner or thicker than the thermally-conductive member 30. One example of the partition sheet 70 is a film including polyimide that is thinner than the thermally-conductive member 30. That is, a thickness of the partition sheet 70 is thinner than a thickness of the thermally-conductive member 30.

The partition sheet 70 is formed in a U-shape as viewed in the lateral direction, and includes a body portion 71 having a downstream end and an upstream end in the conveyance direction, and an extension 72 provided at each of the downstream and upstream ends of the body portion 71.

The body portion 71 extends in the conveyance direction. The body portion 71 is located between the backside surface 16 of the heater 10 and the support portion 21 of the holder 20. More specifically, the body portion 71 is located between the opposite side 32 of the thermally-conductive member 30 and the support portion 21 of the holder 20. The thermally-conductive member 30 is located between the backside surface 16 of the heater 10 and the body portion 71.

The extension 72 extends in the opposed direction from each of the upstream and downstream ends of the body portion 71. More specifically, the extension 72 extends in the opposed direction away from the frontside surface 15 of the heater 10. Further, the extension 72 extends in the opposed direction, to a position farther, than a detection surface 51 (described below) of the temperature detector 50, from the frontside surface 15 of the heater 10. Specifically, the extension 72 extends from each of the upstream and downstream ends of the body portion 71, upward in FIG. 3, to a position above the detection surface 51.

The extension 72 includes a downstream extension 72A provided at the downstream end of the partition sheet 70 in the conveyance direction, and an upstream extension 72B provided at the upstream end of the partition sheet 70 in the conveyance direction. The downstream extension 72A extends from the downstream end of the body portion 71 toward the temperature detector 50 in the opposed direction, and the upstream extension 72B extends from the upstream end of the body portion 71 toward the temperature detector 50 in the opposed direction. A length of the downstream extension 72A and a length of the upstream extension 72B in the opposed direction may either be the same or different.

The support portion 21 of the holder 20 includes an insertion site 23. The insertion site 23 is a groove with a bottom. Specifically, the insertion site 23 is a groove that extends in the lateral direction, with a lower end near the heater 10 (see FIG. 3) being open and an upper end far from the heater 10 (see FIG. 3) being closed. The extension 72 of the partition sheet 70 is inserted into the insertion site 23.

The insertion site 23 includes a downstream insertion site 23A into which the downstream extension 72A is inserted, and an upstream insertion site 23B into which the upstream extension 72A is inserted. A dimension of the downstream insertion site 23A in the opposed direction (a depth of the groove) is greater than the length of the downstream extension 72A in the opposed direction, and a length of the upstream insertion site 23B (a depth of the groove) is longer than the length of the upstream extension 72B in the opposed direction. The length of the downstream insertion site 23A and the length of the upstream insertion site 23B in the opposed direction may be either the same or different.

The temperature detector 50 is a member for detecting the temperature of the heater 10. The temperature detector 50 is positioned on a side of the partition sheet 70 opposite to a side of the partition sheet 70 on which the heater 10 is positioned. The temperature detector 50 is positioned on a side of the partition sheet 70 opposite to a side of the partition sheet 70 on which the thermally-conductive member 30 is positioned. The temperature detector 50 is positioned to hold the body portion 71 of the partition sheet 70 in combination with the thermally-conductive member 30. The body portion 71 is positioned between the temperature detector 50 and the thermally-conductive member 30. The temperature detector 50 has a detection surface 51 that detects a temperature. The temperature detector 50 detects a temperature of an object of which a temperature is to be detected at the detection surface 51.

The detection surface 51 is in contact with the partition sheet 70. More specifically, a second partition sheet 52 is wrapped around the temperature detector 50, and the detection surface 51 is in contact with the body portion 71 of the partition sheet 70 via the second partition sheet 52. The partition sheet 70 is located between the opposite side 32 of the thermally-conductive member 30 and the temperature detector 50. The second partition sheet 52 is made, for example, of a high-heat-resistant plastic or the like. One example of the partition sheet 70 is a film including polyimide.

As shown in FIG. 2B, a plurality of temperature detectors 50 are provided. Specifically, the temperature detector 50 includes a first temperature detector 50A, a second temperature detector 50B, and a third temperature detector 50C. One example of the first temperature detector 50A and the second temperature detector 50B is a thermistor used to regulate the temperature of the heater 10 to a predetermined target temperature. The third temperature detector 50C is a thermostat used to interrupt an electric current to the resistance heating element 12 if the heater 10 heats up to an excessively high temperature.

The plurality of temperature detectors 50 (50A to 50C) are placed inside a contour of the partition sheet 70 as viewed in the opposed direction, as shown in FIG. 2B. To be more specific, the plurality of temperature detectors 50 (50A to 50C) are placed in such positions that detection surfaces 51 thereof are located inside a contour of the same partition sheet 70 as viewed in the opposed direction. The second partition sheet 52 described above is attached to each of the first temperature detector 50A, second temperature detector 50B, and third temperature detector 50C. Thus, the plurality of temperature detectors 50 (50A to 50C) are placed such that the corresponding detection surfaces 51 are each located inside a contour of a different second partition sheet 52 as viewed from the opposed direction.

Returning to FIG. 3, a length L170 of the partition sheet 70 in the conveyance direction is longer than a length L110 of the heater 10 (substrate 11) in the conveyance direction. For example, the length L170 of the partition sheet 70 in the conveyance direction is 0.5 mm to 1.0 mm longer than the length L110 of the heater 10 in the conveyance direction. In one example, the length L170 is 10.5 mm and the length L110 is 10 mm. In the conveyance direction, one end 70A (downstream end) of the partition sheet 70 is located at a position outside (downstream of) one end 10A (downstream end) of the heater 10 (substrate 11), and the other end 70B (upstream end) of the partition sheet 70 is located at a position outside (upstream of) the other end 10B (upstream end) of the heater 10 (substrate 11).

The length L170 of the partition sheet 70 in the conveyance direction is longer than a length L130 of the thermally-conductive member 30 in the conveyance direction. In the conveyance direction, the one end 70A (downstream end) of the partition sheet 70 is located at a position outside (downstream of) one end 30A (downstream end) of the thermally-conductive member 30, and the other end 70B (upstream end) of the partition sheet 70 is located at a position outside (upstream of) the other end 30B (upstream end) of the thermally-conductive member 30.

In the illustrated example, the length L110 of the heater 10 and the length L130 of the thermally-conductive member 30 in the conveyance direction are the same. In the conveyance direction, the one end 10A of the heater 10 and the one end 30A of the thermally-conductive member 30 are located at the same position, and the other end 10B of the heater 10 and the other end 30B of the thermally-conductive member 30 are located at the same position.

Figure 4:
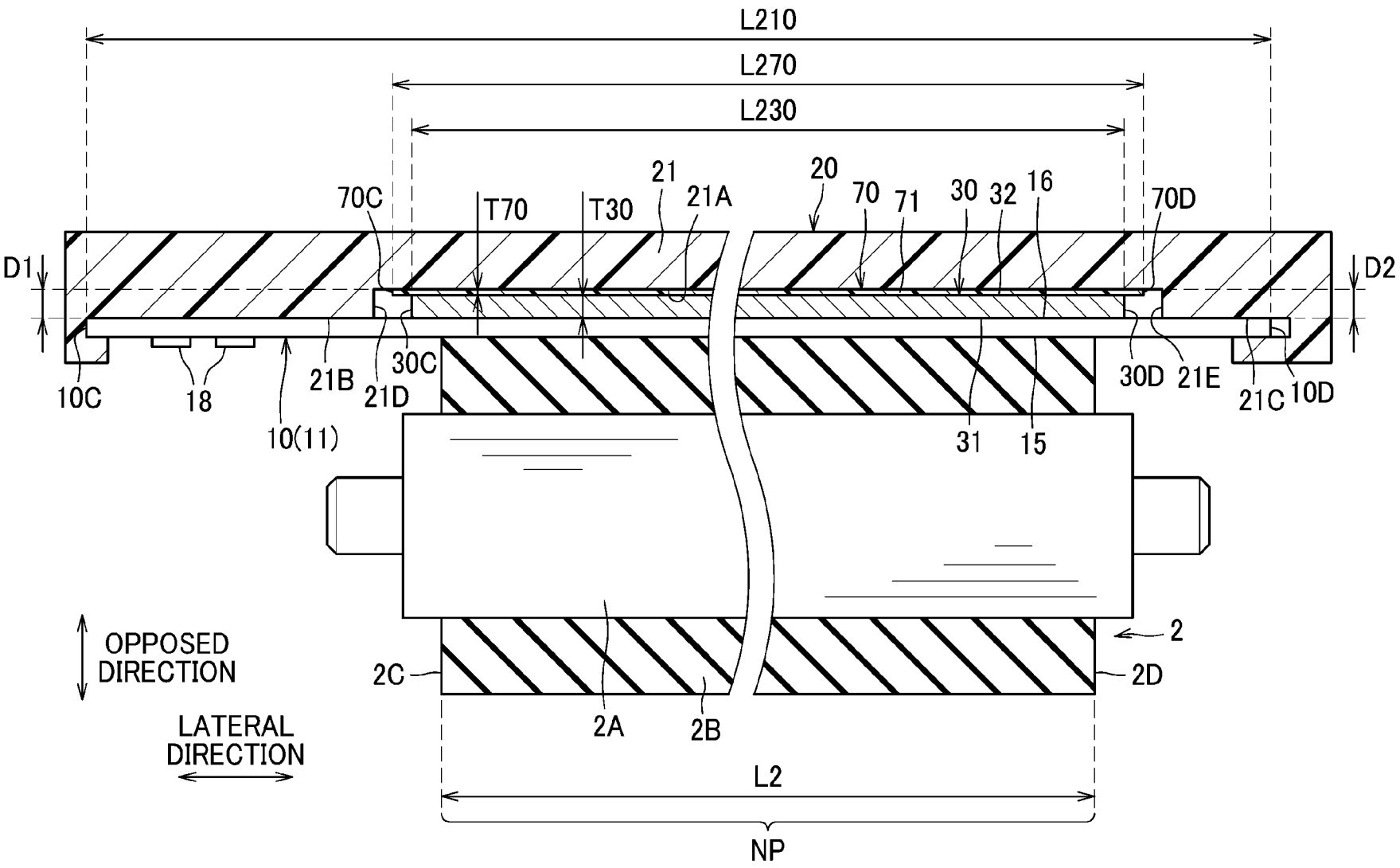
FIG. 4 is a section view of the fixing device in a plane perpendicular to the direction of conveyance of a recording material.

As shown in FIG. 4, a length L270 of the partition sheet 70 in the lateral direction is longer than a length L2 of the nip NP in the lateral direction. For example, the length L270 of the partition sheet 70 in the lateral direction is 8 mm to 12 mm longer than the length L2 of the nip NP in the lateral direction. In one example, the length L270 is 10 mm longer than the length L2, and one end 70C and the other end 70D of the partition sheet 70 in the lateral direction are respectively positioned 5 mm farther outward in the lateral direction than corresponding ends of the nip NP. Specifically, the length L270 of the partition sheet 70 in the lateral direction is longer than a length L2 of the roller portion 2B of the pressure roller 2 in the lateral direction. In the lateral direction, one end 70C of the partition sheet 70 is located at a position outside one end 2C of the roller portion 2B, and the other end 70D of the partition sheet 70 is located at a position outside the other end 2D of the roller portion 2B. The belt 3 is omitted for clarity in FIG. 4.

The length L270 of the partition sheet 70 in the lateral direction is longer than a length L230 of the thermally-conductive member 30 in the lateral direction. In the lateral direction, the one end 70C of the partition sheet 70 is located at a position outside one end 30C of the thermally-conductive member 30, and the other end 70D of the partition sheet 70 is located at a position outside the other end 30D of the thermally-conductive member 30.

The length L230 of the thermally-conductive member 30 in the lateral direction is longer than the length L2 of the roller portion 2B in the lateral direction. In the lateral direction, the one end 30C of the thermally-conductive member 30 is located at a position outside one end 20C of the roller portion 2B, and the other end 30D of the thermally-conductive member 30 is located at a position outside the other end 2D of the roller portion 2B. The roller portion 2B is located within an extent of the partition sheet 70 and an extent of the thermally-conductive member 30 in the lateral direction.

A length L210 of the heater 10 (substrate 11) in the lateral direction is longer than the lengths L270, L230 and L2. In the lateral direction, one end 10C of the heater 10 (substrate 11) is located at a position outside the one end 70C of the partition sheet 70, the one end 30C of the thermally-conductive member 30, and the one end 2C of the roller portion 2B, and the other end 10D of heater 10 (substrate 11) is located at a position outside the other end 70D of the partition sheet 70, the other end 30D of the thermally-conductive member 30, and the other end 2D of the roller portion 2B.

In the illustrated example, the whole opposite surface 32 of the thermally-conductive member 30 is in contact with the body portion 71 of the partition sheet 70, and the whole heater-side surface 31 of the thermally-conductive member 30 is in contact with the backside surface 16 of the heater 10. Thus, the contact area between the body portion 71 of partition sheet 70 and the opposite surface 32 of the thermally-conductive member 30 is the same as the contact area between the backside surface 16 of the heater 10 and the heater-side surface 31 of the thermally-conductive member 30.

The support portion 21 of the holder 20 has a first surface 21A, a second surface 21B, a third surface 21C, a fourth surface 21D connecting the neighboring edges of the first surface 21A and the second surface 21B and a fifth surface 21E connecting the neighboring edges of the first surface 21A and the third surface 21C. The first surface 21A, the second surface 21B, and the third surface 21C are surfaces perpendicular to the opposed direction and facing the heater 10. The fourth surface 21D and the fifth surface 21E are surfaces perpendicular to the lateral direction.

The first surface 21A supports the partition sheet 70 and the thermally-conductive member 30. Specifically, the first surface 21A is in contact with the body portion 71 of the partition sheet 70 to support the partition sheet 70, and supports the thermally-conductive member 30 via the body portion 71 of the partition sheet 70. The length of the first surface 21A in the lateral direction is longer than the length L230 of the thermally-conductive member 30 in the lateral direction, and longer than the length L270 of the partition sheet 70 in the lateral direction. The thermally-conductive member 30 and the partition sheet 70 are positioned within the bounds of the first surface 21A in the lateral direction.

The second surface 21B and the third surface 21C are surfaces that support the backside surface 16 of the heater 10, and are located at positions outside the first surface 21A in the lateral direction. Specifically, the second surface 21B is located on one side of the first surface 21A in the lateral direction, and is in contact with one end portion of the backside surface 16 of the heater 10 in the lateral direction to support the backside surface 16 of the heater 10. The third surface 21C is located on the other side of the first surface 21A in the lateral direction, and is in contact with the other end portion of the backside surface 16 of the heater 10 in the lateral direction to support the backside surface 16 of the heater 10.

The second surface 21B and the third surface 21C are located closer, than the first surface 21A, to the heater 10, in the opposed direction. The second surface 21B and the third surface 21C are located at the same position in the opposed direction. The first surface 21A, the fourth surface 21D and the fifth surface 21E form an indentation in the support portion 21. The indentation is dented inward from the second surface 21B and the third surface 21C. The body portion 71 of the partition sheet 70 and the thermally-conductive member 30 are placed in the indentation.

A length of the fourth surface 21D in the opposed direction, i.e., a distance D1 between the first surface 21A and the second surface 21B in the opposed direction is equal to or smaller than a sum of a thickness T70 of the partition sheet 70 and a thickness T30 of the thermally-conductive member 30. Similarly, a length of the fifth surface 21E in the opposed direction, i.e., a distance D2 between the first surface 21A and the third surface 21B in the opposed direction is equal to or smaller than the sum of the thickness T70 of the partition sheet 70 and the thickness T30 of the thermally-conductive member 30. The distances D1, D2 are preferably equal to the sum of the thickness T70 of the partition sheet 70 and the thickness T30 of the thermally-conductive member 30.

According to the fixing device described above, since the length L170 of the partition sheet 70 in the conveyance direction is longer than the length L110 of the heater 10 in the conveyance direction, as shown in FIG. 3, lubricant provided between the heater 10 and the belt 3 can be restrained by the partition sheet 70 from flowing to the backside of the partition sheet 70, i.e., to the side on which the temperature detector 50 is located. Thus, lubricant can be restrained from adhering, for example, to the detection surface 51 of the temperature detector 50, so that the temperature detector 50 can fully perform its function.

Since the partition sheet 70 has the extension 72 and the holder 20 has the insertion site 23 in which the extension 72 is inserted, lubricant can be further restrained from flowing to the temperature detector 50. Further, the partition sheet 70 can be restrained from moving in the conveyance direction, for example, in accordance with thermal expansion of the heater 10.

Lubricant has a tendency to flow to the downstream side of the heater 10 in the conveyance direction as the belt 3 rotates. Therefore, by the extension 72 including the downstream extension 72A provided at the downstream end of the partition sheet 70 in the conveyance direction, lubricant can be effectively restrained from flowing to the temperature detector 50 at the downstream side in the conveyance direction.

Even if lubricant flows into the insertion site 23 along the partition sheet 70, since the insertion site 23 is a groove with a bottom, further intrusion of lubricant can be restrained. Lubricant can thereby be further restrained from flowing to the temperature detector 50.

Since the extension 72 extends in the opposed direction, to a position farther, than the detection surface 51 of the temperature detector 50, from the frontside surface 15 of the heater 10, lubricant can be further restrained from flowing to the temperature detector 50 compared to an alternative extension with a shorter length in the opposed direction.

Since the thermally-conductive member 30 is located between the heater 10 and the partition sheet 70, lubricant can be further restrained from flowing to the temperature detector 50. Further, in early stages of printing, the temperature distribution of the heater 10 can be made closer to a uniform distribution by the thermally-conductive member 30, and heat transferred to the temperature detector 50 can be reduced by the partition sheet 70. Thus, since a drop in temperature of the belt 3 can be restrained in the early stages of printing, fixing can be performed sufficiently.

Since the area of contact between the partition sheet 70 and the thermally-conductive member 30 is the same as the area of contact between the heater 10 and the thermally-conductive member 30, heat transferred to the temperature detector 50 in the early stages of printing can be reduced by the partition sheet 70.

Even if the partition sheet 70 is subject to a force in the lateral direction, for example, in accordance with thermal expansion of the heater 10, the movement of the partition sheet 70 in the lateral direction can be restrained by the surface (fourth surface 21D) between the first surface 21A and the second surface 21B, and the surface (fifth surface 21E) between the first surface 21A and the third surface 21C, such as shown in FIG. 4.

Since the distances D1, D2 are equal to or smaller than the sum of the thickness T70 of the partition sheet 70 and the thickness T30 of the thermally-conductive member 30, spaces formed when the pressure roller 2 is pressed against the heating unit 1, between the heater 10 and the thermally-conductive member 30, between the thermally-conductive member 30 and the partition sheet 70, and between the partition sheet 70 and the first surface 21A of the holder 20 can be minimized.

Since the length L270 of the partition sheet 70 in the lateral direction is longer than the length L2 of the nip NP in the lateral direction, lubricant can be restrained from flowing to the temperature detector 50 along an edge in the lateral direction of the partition sheet 70.

Since the plurality of temperature detectors 50 (50A to 50C) are placed, as shown in FIG. 2B, inside a contour of the single partition sheet 70 as viewed in an opposed direction, lubricant can be restrained from flowing to the temperature detector 50 by a single partition sheet 70 even if a plurality of temperature detectors 50 are included. Thus, in comparison with, for example, providing one partition sheet for each temperature detector, the number of components of the fixing device F can be reduced, and lubricant can be restrained from flowing to the temperature detector through gaps between neighboring partition sheets.

Since the partition sheet 70 is a film including polyimide, the partition sheet 70 can be made thin.

Although the area of contact between the partition sheet 70 and the thermally-conductive member 30 and the area of contact between the heater 10 and the thermally-conductive member 30 are the same in the above-illustrated example, the area of contact between the partition sheet and the thermally-conductive member may be larger than the area of contact between the heater and the thermally-conductive member. This further reduces heat transferred to the temperature detector due to the partition sheet in the early stages of printing.

Next, another example of the fixing device F will be described. In the following description, features different from the above-illustrated example will be described in detail, while the same features as those of the above-illustrated example will be identified by the same reference characters and descriptions thereof will be omitted as appropriate.

Figure 5:
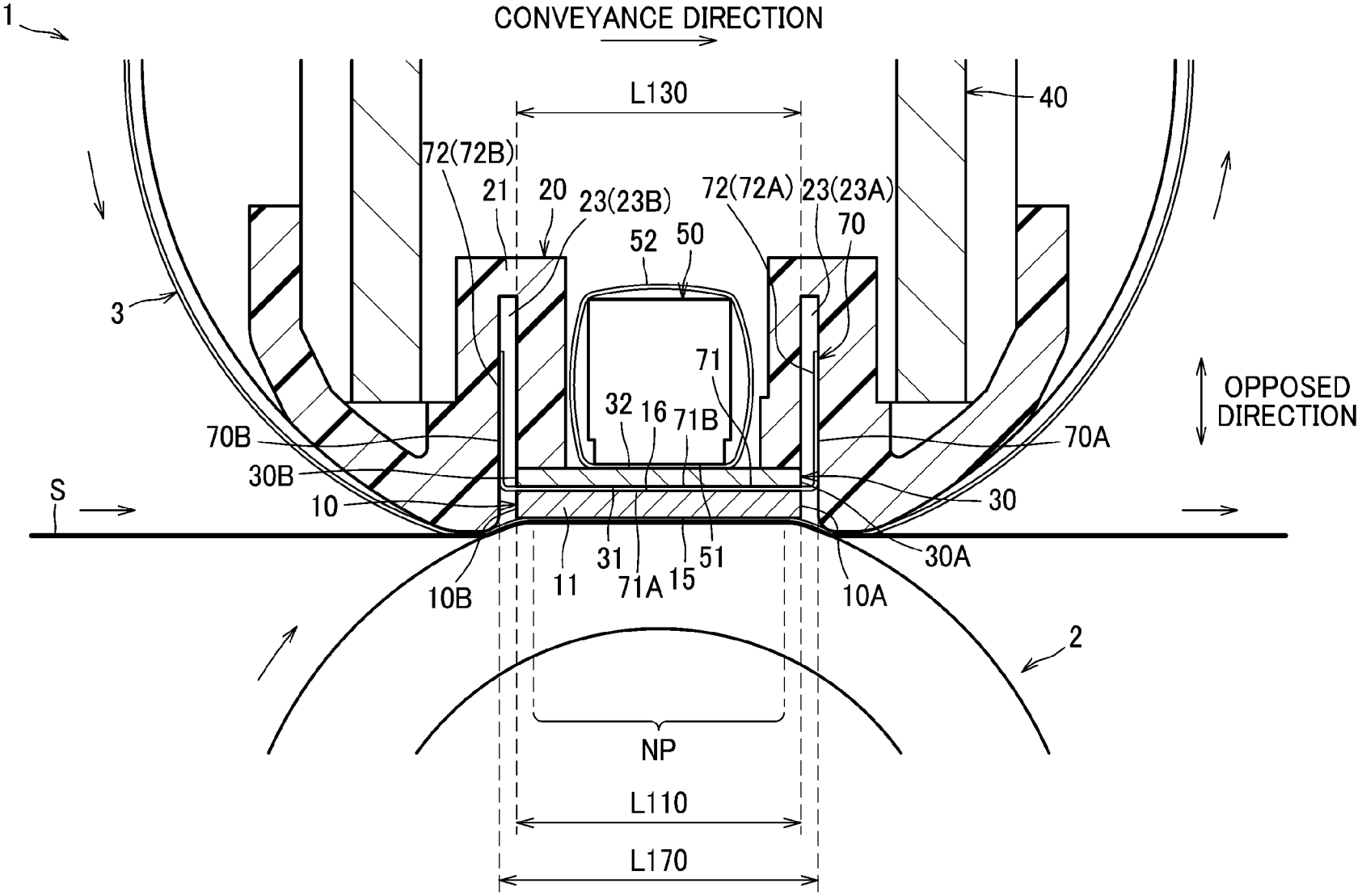
FIG. 5 is an enlarged section view, showing a partition sheet and its vicinity, of another example of a fixing device.

As shown in FIG. 5, a fixing device F comprises a heating unit 1 that comprises a belt 3, a heater 10, a holder 20, a thermally-conductive member 30, a stay 40, a temperature detector 50, and a partition sheet 70. The difference of this example from the above-illustrated example lies in the location of the thermally-conductive member 30 and the partition sheet 70.

The partition sheet 70 includes a body portion 71 with a sheet frontside surface 71A and a sheet backside surface 71B opposite to the sheet frontside surface 71A. The partition sheet 70 is positioned so that the sheet frontside surface 71A is in contact with a backside surface 16 of the heater 10 and the sheet backside surface 71B is in contact with a heater-side surface 31 of the thermally-conductive member 30. In other words, in this example, the partition sheet 70 (body portion 71) is located between the back side surface 16 of the heater 10 and the heater-side surface 31 of the thermally-conductive member 30. Further, the thermally-conductive member 30 is located between the sheet backside surface 71B of the partition sheet 70 and a support portion 21 of the holder 20.

In this example, similar to the above-illustrated example, a length L170 of the partition sheet 70 in the conveyance direction is longer than a length L110 of the heater 10 in the conveyance direction. In the conveyance direction, one end 70A (downstream end) and the other end 70B (upstream end) of the partition sheet 70 are respectively located at positions outside one end 10A (downstream end) and the other end 10B (upstream end) of the heater 10. Further, the length L170 of the partition sheet 70 in the conveyance direction is longer than a length L130 of the thermally-conductive member 30 in the conveyance direction. In the conveyance direction, the one end 70A (downstream end) and the other end 70B (upstream end) of the partition sheet 70 are respectively located at positions outside one end 30A (downstream end) and the other end 30B (upstream end) of the thermally-conductive member 30.

Figure 6:
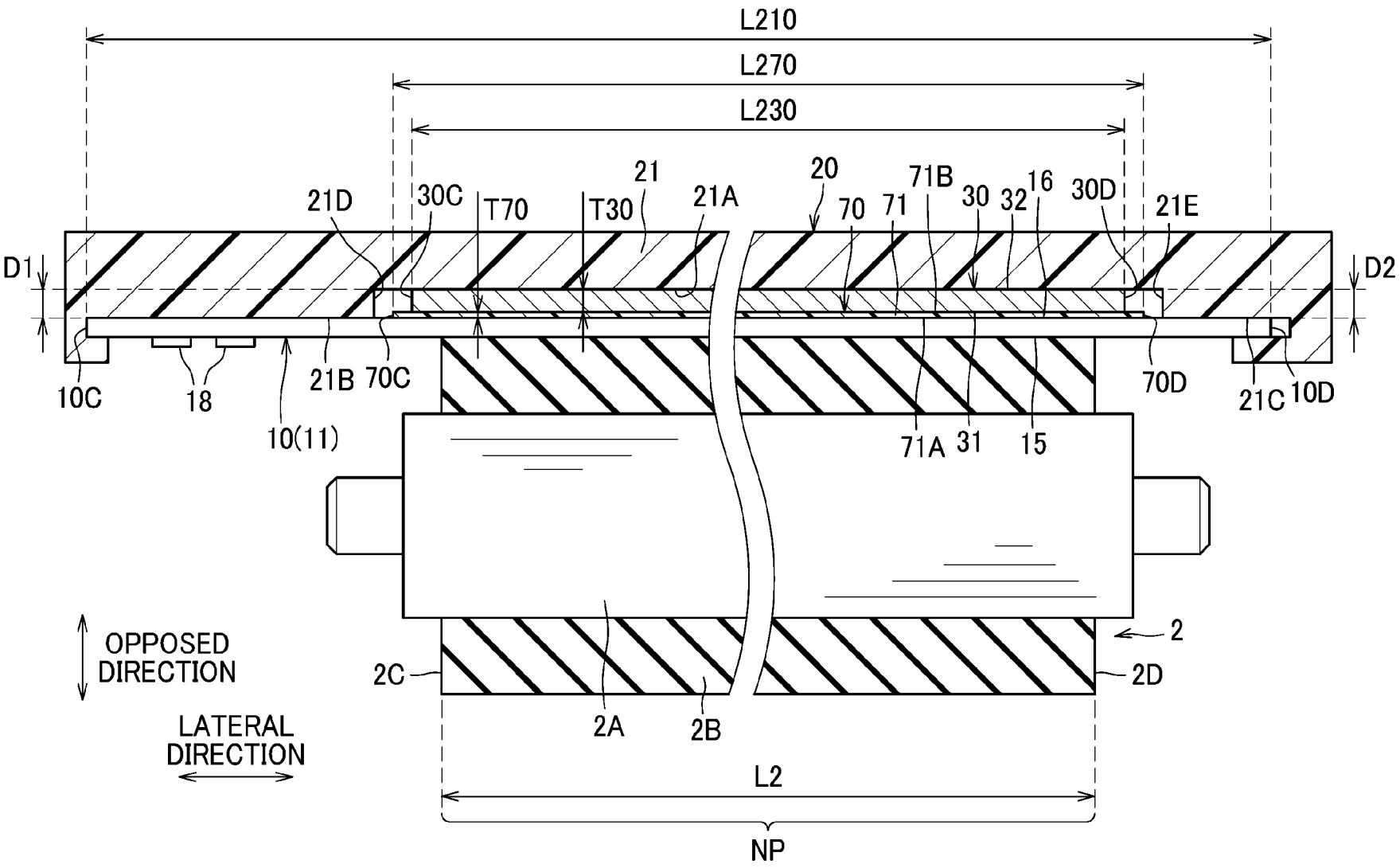
FIG. 6 is a section view of the fixing device of FIG. 5 in a plane perpendicular to the direction of conveyance of a recording material.

Further, as shown in FIG. 6, a length L270 of the partition sheet 70 in the lateral direction is longer than a length L230 of the thermally-conductive member 30 in the lateral direction. In the lateral direction, one end 70C and the other end 70D of the partition sheet 70 are respectively located at positions outside one end 30C and the other end 30D of the thermally-conductive member 30.

Accordingly, the partition sheet 70 is positioned to cover the thermally-conductive member 30, as viewed in the opposed direction from the heater 10 side. Thus, in this example, the heater 10 and the thermally-conductive member 30 are not in contact with each other.

Returning to FIG. 5, the fixing device F further comprises a temperature detector 50 having a detection surface 51 in contact with the thermally-conductive member 30. Specifically, the detection surface 51 is in contact with an opposite surface 32 of the thermally-conductive member 30 via a second partition sheet 52.

In this example, similar to the example illustrated above, since the length L170 of the partition sheet 70 is longer in the conveyance direction than the length L110 of the heater 10 in the conveyance direction, lubricant provided between the heater 10 and the belt 3 can be restrained by the partition sheet 70 from flowing to the temperature detector 50.

Since the partition sheet 70 is located between the heater 10 and the thermally-conductive member 30, heat transferred to the thermally-conductive member 30 in early stages of heating by the heater 10 can be reduced by the partition sheet 70. Further, since the thermally-conductive member 30 allows the temperature distribution of the heater 10 to be brought closer to a uniform distribution during printing, the ends of the heater 10 in the lateral direction can be restrained from excessively heating up.

Since the heater 10 is not in contact with the thermally-conductive member 30, heat transferred to the thermally-conductive member 30 in the early stages of heating by the heater 10 can be further reduced.

Since the detection surface 51 of the temperature detector 50 is in contact with the thermally-conductive member 30, the temperature of the heater 10 can be detected via the thermally-conductive member 30.

In this example, similar to the above-illustrated example, since distances D1, D2 are equal to or smaller than a sum of a thickness T70 of the partition sheet 70 and a thickness T30 of the thermally-conductive member 30, as shown in FIG. 6, spaces formed when a pressure roller 2 is pressed against the heating unit 1, between the heater 10 and the partition sheet 70, between the partition sheet 70 and the thermally-conductive member 30, and between the thermally-conductive member 30 and the first surface 21A of the holder 20 can be minimized.

Figure 7:
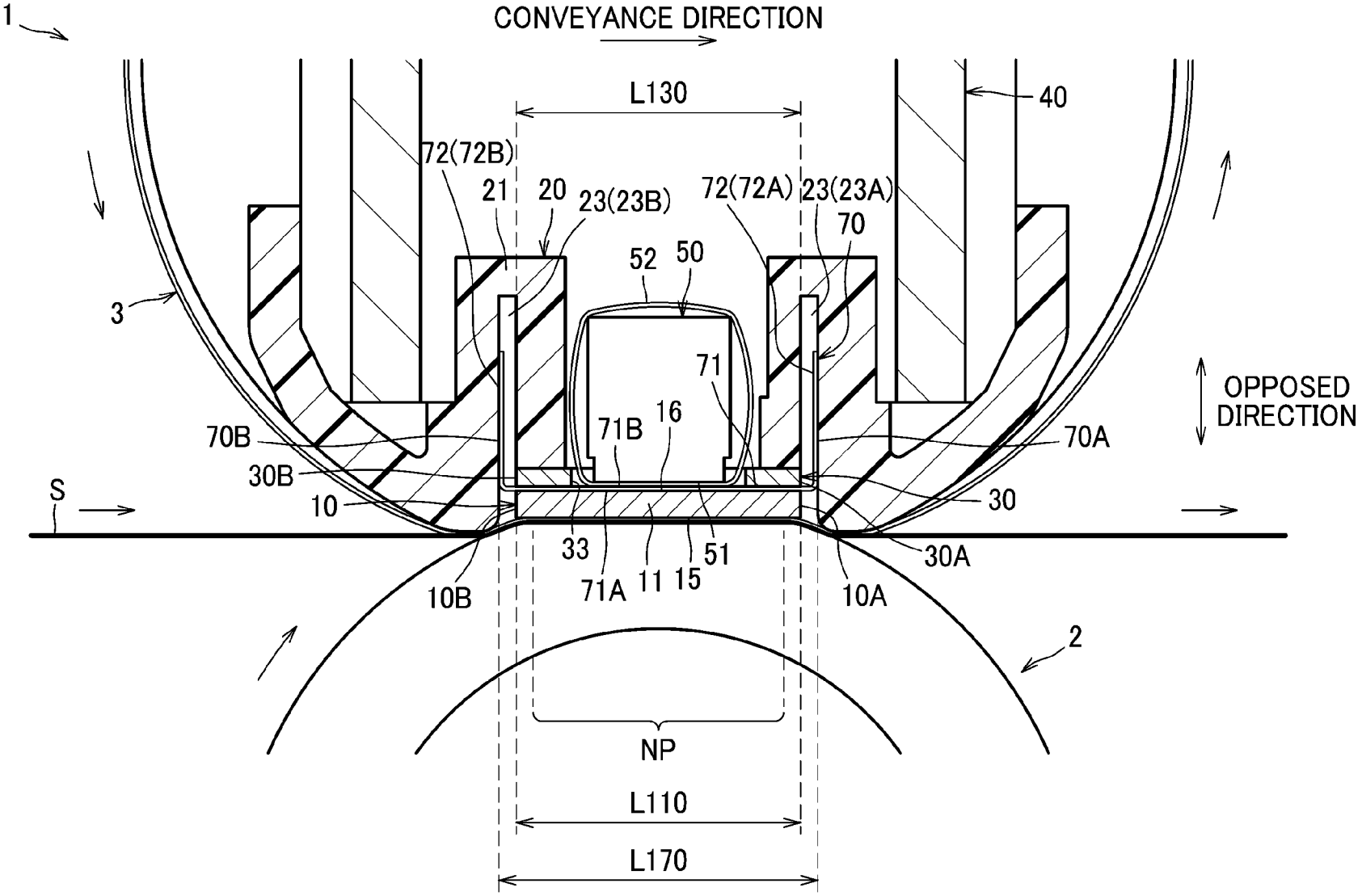
FIG. 7 is an enlarged section view, showing a partition sheet and its vicinity, of yet another example of a fixing device.

Next, a further example of the fixing device F will be described. As shown in FIG. 7, in this example, the thermally-conductive member 30 has a through hole 33 that penetrates the thermally-conductive member 30 in the opposed direction. The temperature detector 50 is configured such that the detection surface 51 is in contact with the partition sheet 70 through the through hole 33. Specifically, the detection surface 51 is in contact with the sheet backside surface 71B of the partition sheet 70 (body portion 71) via the second member 51.

Figure 8:
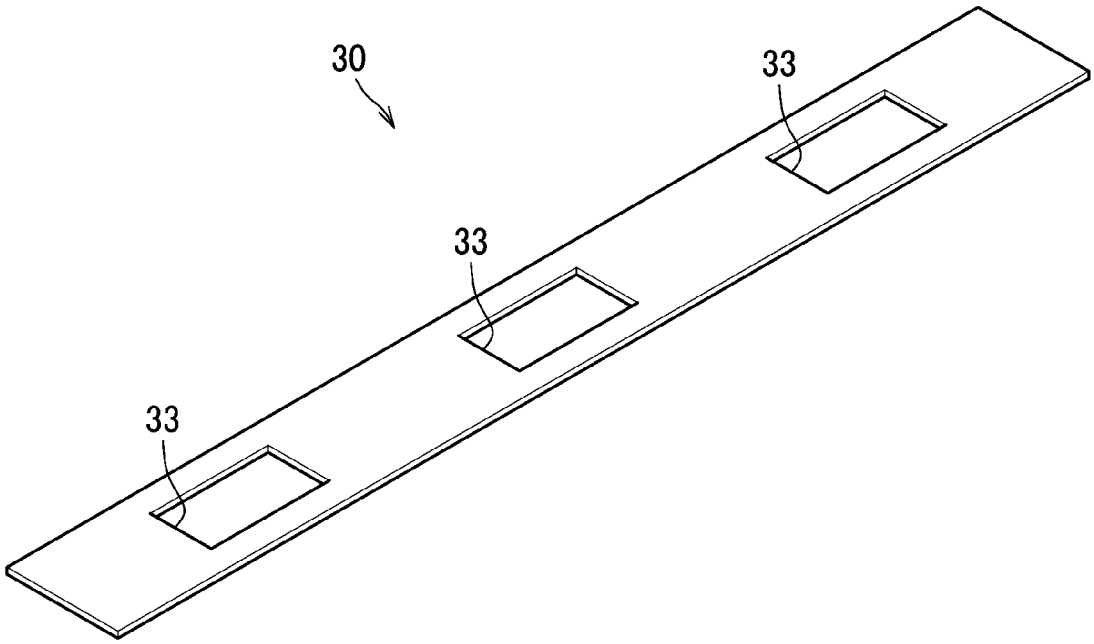
FIG. 8 is a perspective view of a thermally-conductive member of the fixing device of FIG. 7.

As shown in FIG. 8, the through hole 33 includes three through holes 33, each provided for a corresponding one of the three temperature detectors 50, i.e., the first temperature detector 50A, the second temperature detector 50B, and the third temperature detector 50C (see FIG. 2).

According to this example, similar to the above-illustrated examples, lubricant provided between the heater 10 and the belt 3 can be restrained by the partition sheet 70 from flowing to the temperature detector 50.

Since the temperature detector 50 is configured such that the detection surface 51 is in contact with the partition sheet 70 through the through hole 33 in the thermally-conductive member 30, the temperature detector 50 can detect the temperature of the heater 10 via the partition sheet 70.

Figure 9A:
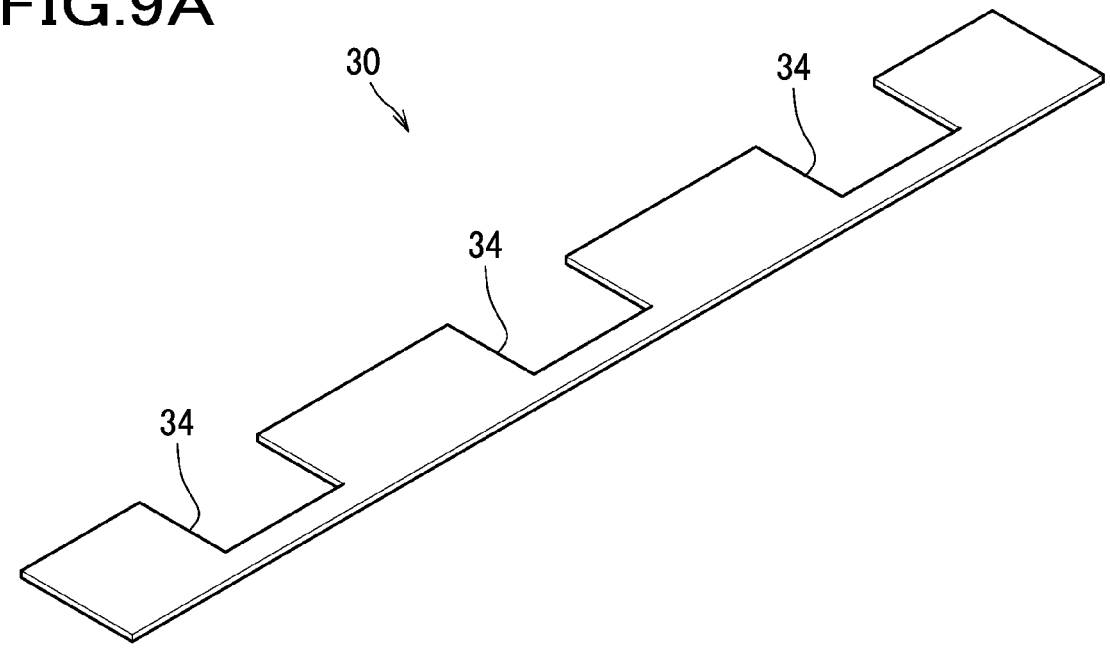
FIG. 9A is a perspective view of an alternative thermally-conductive member.
Figure 9B:
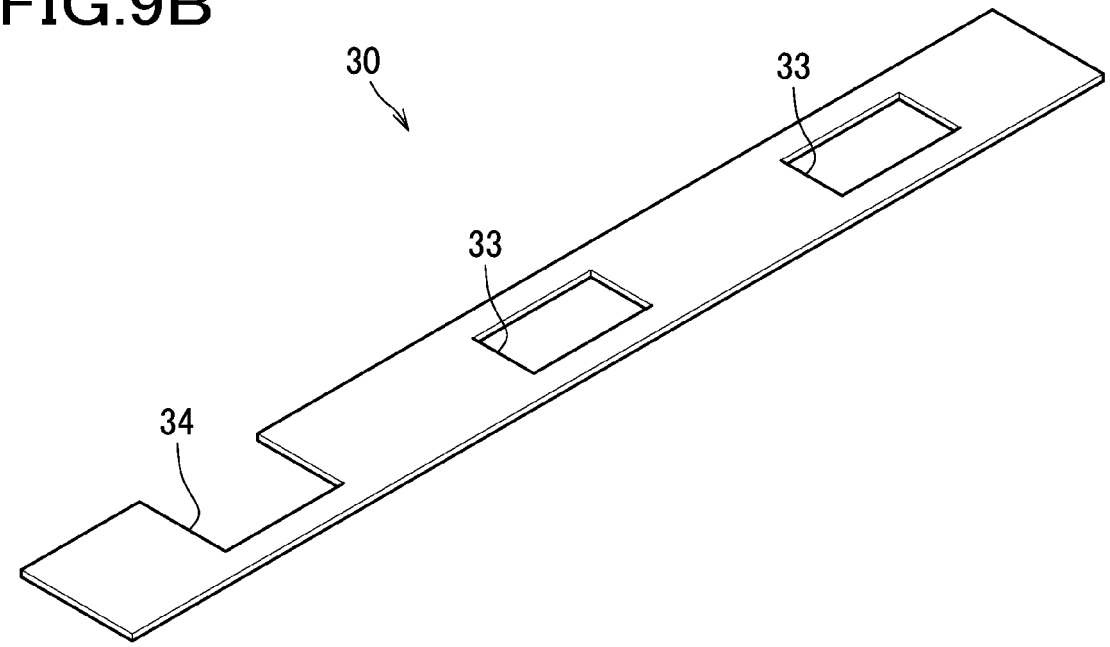
FIG. 9B is a perspective view of another alternative thermally-conductive member.

In this example, the thermally-conductive member 30 has the through hole 33, and the temperature detector 50 is configured such that the detection surface 51 is in contact with the partition sheet 70 through the through hole 33. However, as shown in FIG. 9A, the thermally-conductive member 30 may be configured to include a notch 34, and the temperature detector 50 (not shown) may be configured such that the detection surface 51 is in contact with the partition sheet 70 through the notch 34. This also allows the temperature of the heater 10 to be detected via the partition sheet 70. Further, as shown in FIG. 9B, the thermally-conductive member 30 may include both of the through hole(s) 33 and the notch(es) 34.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below.

Although the length L130 of the thermally-conductive member 30 in the conveyance direction is the same as the length L110 of the heater 10 in the conveyance direction in the above-illustrated example, a length of the thermally-conductive member 30 in the conveyance direction may be longer than a length of the heater in the conveyance direction. It is to be understood that if the length of the thermally-conductive member in the conveyance direction is longer than the length of the heater in the conveyance direction, a length of the partition sheet in the conveyance direction may be the same as the length of the thermally-conductive member in the conveyance direction.

Although the partition sheet 70 includes the extension 72 on both ends (upstream and downstream ends) in the conveyance direction in the above-illustrated example, the partition sheet 70 may be configured such that the extension is formed only on one end (upstream or downstream end) in the conveyance direction. In this case, the one end may be the downstream end of the partition sheet in the conveyance direction. That is, the partition sheet may be configured such that the extension is formed only at the downstream end thereof in the conveyance direction.

Although the extension 72 of the partition sheet 70 extends in the opposed direction, to a position farther, than the detection surface 51 of the temperature detector 50, from the frontside surface 15 of the heater 10 in the above-illustrated example, the extension may, referring to FIG. 5, have a length such that the extension is located between the detection surface 51 of the temperature detector 50 and the heater-side surface of the thermally-conductive member 30 in the opposed direction.

Although the insertion site 23 is a groove with a bottom in the above-illustrated example, the insertion site may be, for example, a hole shaped as a slit that penetrates the support portion in the opposed direction.

Although three temperature detectors 50 are provided in the above-illustrated example, any number of temperature detectors may be provided. Further, although a plurality of temperature detectors 50 are provided in the above-illustrated example, only one temperature detector may be provided.

Although the detection surface 51 of the temperature detector 50 is in contact with the partition sheet 70 or the thermally-conductive member 30 via the second partition sheet 52 in the above-illustrated example, the fixing device may not include the second partition sheet and may be configured such that the detection surface of the temperature detector is directly in contact with the partition sheet or the thermally-conductive member. Further, the detection surface of the temperature detector may be, for example, in contact with the partition sheet or the thermally-conductive member via a member having an indefinite shape such as grease, instead of the second partition sheet.

Although the surface (fourth surface 21D) between the first surface 21A and the second surface 21B is a surface perpendicular to the lateral direction in the above-illustrated example, the surface between the first surface 21A and the second surface 21B may be a surface inclined with respect to the lateral direction. The same can be said regarding the surface between the first surface and the third surface.

Although the partition sheet 70 and the thermally-conductive member 30 are respectively formed of one sheet-shaped member in the above-illustrated example, the partition sheet and the thermally-conductive member may be formed of a combination of a plurality of sheet-shaped members. In this case, the material, thermal conductivity and/or shape of the plurality of sheet-shaped members may be either different from each other or the same.

Although the substrate 11 of the heater 10 is formed of an elongated rectangular plate made of ceramic in the above-illustrated example, the substrate of the heater may be formed of an elongated rectangular plate made of metal such as stainless steel.

Although the pressure roller 2 is given as an example of the pressure unit in the above-illustrated example, the pressure unit may be a device comprising a second endless belt, a pressing pad that holds the second endless belt in combination with the heating unit, and a second holder that holds the pressure pad.

The elements described in the above illustrated examples may be implemented selectively and in combination.

What is claimed is:

1. A fixing device comprising:

a heater comprising a substrate, and a resistance heating element provided on the substrate, the heater having a frontside surface and a backside surface opposite to the frontside surface;

an endless belt configured to rotate around the heater, the endless belt having an inner peripheral surface in contact with the frontside surface of the heater, with lubricant being provided between the endless belt and the frontside surface;

a holder that holds the heater;

a temperature detector configured to detect a temperature of the heater, the temperature detector having a detection surface that detects a temperature; and a partition sheet located between the backside surface of the heater and the holder, the partition sheet being in contact with the detection surface;

wherein a length of the partition sheet in a direction of conveyance of a recording material is longer than a length of the heater in the direction of conveyance, wherein the partition sheet includes an extension that extends from at least one end that is at least one of two ends upstream and downstream in the direction of conveyance, the extension extending away from the frontside surface in an opposed direction in which the backside surface of the heater and a surface of the partition sheet are opposed to each other, and wherein the holder includes a groove in which the extension is inserted.

2. The fixing device according to claim 1, wherein the at least one end is a downstream end of the partition sheet in the direction of conveyance.

3. The fixing device according to claim 1, wherein the groove has a bottom.

4. The fixing device according to claim 1, wherein the extension extends in the opposed direction, to a position farther, than the detection surface, from the frontside surface.

5. The fixing device according to claim 1, wherein the partition sheet has a thermal conductivity lower than a thermal conductivity of the substrate.

6. The fixing device according to claim 5, further comprising a thermally-conductive member located between the backside surface of the heater and the partition sheet, the thermally-conductive member having a higher thermal conductivity than the thermal conductivity of the substrate, wherein the length of the partition sheet in the direction of conveyance is longer than a length of the thermally-conductive member in the direction of conveyance.

7. The fixing device according to claim 6, wherein an area of contact between the partition sheet and the thermally-conductive member is equal to or larger than an area of contact between the heater and the thermally-conductive member.

8. The fixing device according to claim 6, wherein the holder has:

a first surface that supports the partition sheet and the thermally-conductive member; and a second surface that supports the backside surface of the heater, the second surface being located in a position outside the first surface in a direction perpendicular to the direction of conveyance, and closer, than the first surface, to the heater.

9. The fixing device according to claim 8, wherein a distance between neighboring edges of the first surface and the second surface is equal to or smaller than a sum of a thickness of the partition sheet and a thickness of the thermally-conductive member.

10. The fixing device according to claim 1, further comprising a pressure roller that forms a nip in combination with the heater, the belt being held in the nip between the pressure roller and the heater, and wherein a length of the partition sheet in a direction perpendicular to the direction of conveyance is longer than the length of the nip in the direction perpendicular to the direction of conveyance.

11. The fixing device according to claim 1, comprising at least one other temperature detector that detects a temperature of the heater, the at least one other temperature detector being positioned on a side of the partition sheet opposite to a side of the partition sheet on which the heater is positioned, wherein the temperature detector and the at least one other temperature detector are placed inside a contour of the partition sheet as viewed in an opposed direction in which the backside surface of the heater and a surface of the partition sheet are opposed to each other.

12. The fixing device according to claim 1, wherein the partition sheet includes polyimide.

13. A fixing device comprising:

a heater comprising a substrate, and a resistance heating element provided on the substrate, the heater having a frontside surface and a backside surface opposite to the frontside surface;

an endless belt configured to rotate around the heater, the endless belt having an inner peripheral surface in contact with the frontside surface of the heater, with lubricant being provided between the endless belt and the frontside surface;

a holder that holds the heater;

a temperature detector configured to detect a temperature of the heater, the temperature detector having a detection surface that detects a temperature;

a thermally-conductive member located between the backside surface of the heater and the holder, the thermally-conductive member having a higher thermal conductivity than a thermal conductivity of the substrate and being in contact with the detection surface; and a partition sheet in contact with the backside surface of the heater and the thermally-conductive member, the partition sheet having a thermal conductivity lower than the thermal conductivity of the substrate, wherein a length of the partition sheet in a direction of conveyance of a recording material is longer than a length of the heater in the direction of conveyance.

14. The fixing device according to claim 13, wherein the heater is not in contact with the thermally-conductive member.

15. A fixing device comprising:

a heater comprising a substrate, and a resistance heating element provided on the substrate, the heater having a frontside surface and a backside surface opposite to the frontside surface;

an endless belt configured to rotate around the heater, the endless belt having an inner peripheral surface in contact with the frontside surface of the heater, with lubricant being provided between the endless belt and the frontside surface;

a holder that holds the heater;

a temperature detector configured to detect a temperature of the heater, the temperature detector having a detection surface that detects a temperature;

a thermally-conductive member located between the backside surface of the heater and the holder, the thermally-conductive member having a higher thermal conductivity than a thermal conductivity of the substrate and having a through hole or a notch; and a partition sheet in contact with the backside surface of the heater and the thermally-conductive member, the partition sheet having a thermal conductivity lower than the thermal conductivity of the substrate, wherein the detection surface is in contact with the partition sheet through the through hole or the notch, and wherein a length of the partition sheet in a direction of conveyance of a recording material is longer than a length of the heater in the direction of conveyance.

* * * * *